US012448740B2

(12) United States Patent
Engel et al.

(10) Patent No.: US 12,448,740 B2
(45) Date of Patent: Oct. 21, 2025

(54) STEPPED DEFLECTOR FOR A SCREED ASSEMBLY

(71) Applicant: Caterpillar Paving Products Inc., Brooklyn Park, MN (US)

(72) Inventors: Brett Wayne Engel, Otsego, MN (US); Anthony Paul Steinhagen, Maple Grove, MN (US); John E. Jorgensen, Andover, MN (US); Ryan T. Thiesse, Otsego, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 1045 days.

(21) Appl. No.: 17/499,459

(22) Filed: Oct. 12, 2021

(65) Prior Publication Data

US 2023/0115734 A1 Apr. 13, 2023

(51) Int. Cl.
*E01C 19/40* (2006.01)

(52) U.S. Cl.
CPC ..... *E01C 19/40* (2013.01)

(58) Field of Classification Search
CPC ..... E01C 19/40
See application file for complete search history.

(56) References Cited

U.S. PATENT DOCUMENTS

| | | | | |
|---|---|---|---|---|
| 3,155,021 | A * | 11/1964 | Gebhardt, Jr. | E01C 19/40 269/49 |
| 4,507,014 | A * | 3/1985 | Heims | E01C 19/40 404/133.05 |
| 5,088,854 | A | 2/1992 | Sovik | |
| 6,190,087 | B1 * | 2/2001 | Rower | E01C 19/40 404/104 |
| 6,520,716 | B2 * | 2/2003 | Rower | E01C 19/42 404/104 |
| 9,683,337 | B2 | 6/2017 | Ellwein et al. | |
| 10,246,834 | B1 * | 4/2019 | Ellwein | E01C 19/48 |
| 2006/0034658 | A1 * | 2/2006 | Heims | E01C 19/40 404/114 |
| 2016/0265173 | A1 * | 9/2016 | Ellwein | E01C 19/4873 |
| 2020/0277742 | A1 * | 9/2020 | Mahler | E01C 19/48 |

FOREIGN PATENT DOCUMENTS

| | | | |
|---|---|---|---|
| CN | 207469053 | U | 6/2018 |
| EP | 3613899 | A1 * | 2/2020 |
| JP | 3824192 | B2 | 9/2006 |

* cited by examiner

*Primary Examiner* — Abigail A Risic

(57) ABSTRACT

A deflector for a screed assembly includes a front surface, a bottom surface, and a stepped transition connecting the front surface to the bottom surface.

17 Claims, 5 Drawing Sheets

STEPPED DEFLECTOR FOR A SCREED ASSEMBLY

TECHNICAL FIELD

The present disclosure relates generally to paving machines, and, more specifically, to deflector plates used in the screed assembly of such paving machines.

BACKGROUND

Paving machines are used to lay and level a paving material such as asphalt, on a ground surface for the construction of roads, bridges, parking lots, and other such surfaces. In general, paving machines include a chassis, a hopper for storing the paving material, an auger that distributes the paving material on a ground surface, and a screed assembly that compacts/levels the paving material to a desired mat thickness. The screed assembly may be rear-mounted on the paving machine behind the hopper, the chassis, and the auger relative to the direction of travel. The screed assembly may include a main screed and or more extension screeds mounted behind (or in front of) the main screed. Such extension screeds may be omitted in other paving machines.

The screed assembly may include a bottom-facing screed plate that compacts the paving material on the ground surface at a pre-determined "angle of attack". Also, some screed assembly designs may also include a tamper bar at the front of the screed assembly that moves up and down to pre-compact the paving material. A deflector may also be provided in front of the tamper bar that contacts the paving material before the tamper bar.

U.S. Pat. No. 9,683,337 discloses a screed assembly for a paving machine that may comprise a main screed and an extension screed configured to extend from the main screed to a fully-extended position. The extension screed may include a deflector and a material bypass prevention plate affixed to the extension screed. The material bypass prevention plate may have a projection that extends into and fills a space between the material bypass prevention plate and the main screed when the extension screed is in the fully-extended position.

As can be seen, there still exists a need to improve the functional interaction between the deflector, and the tamper bar.

SUMMARY

A deflector for use with a screed assembly according to an embodiment of the present disclosure may comprise a front surface, a bottom surface, and a stepped transition connecting the front surface to the bottom surface.

A stepped deflector for use with a screed assembly according to another embodiment of the present disclosure may comprise a stepped plate including a bottom compacting surface, a front surface, an attack surface extending rearwardly from the front surface, and an accumulation surface extending downwardly from the attack surface toward the bottom compacting surface.

A screed assembly for use with a paving machine having a direction of travel according to yet another embodiment of the present disclosure may comprise a stepped deflector plate with a bottom edge, and a tamper bar disposed near the bottom edge of the deflector that is configured to move up and down vertically to pre-compact paving material. The tamper bar may define a chamfer angle relative to the direction of travel. The stepped deflector plate may include a frontmost surface, a bottommost surface, and at least a pair of planar surfaces that are offset from each other along a direction that is perpendicular to the direction of travel, and that are both parallel with the chamfer angle of the tamper bar.

BRIEF DESCRIPTION OF THE DRAWINGS

The accompanying drawings, which are incorporated in and constitute a part of this specification, illustrate several embodiments of the disclosure and together with the description, serve to explain the principles of the disclosure. In the drawings.

DETAILED DESCRIPTION

Figure 1:
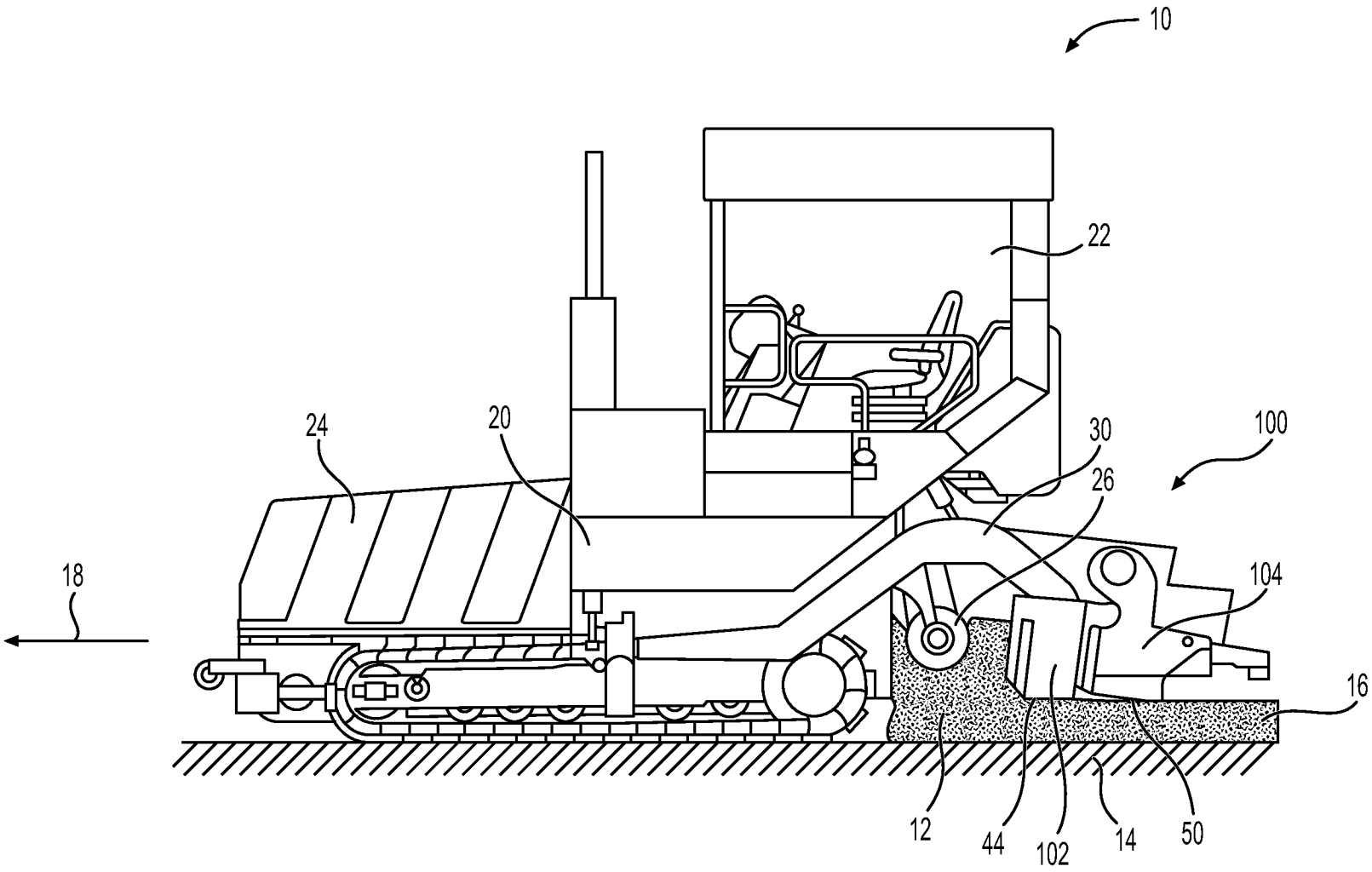
FIG. 1 is a side view of a paving machine that may use a screed assembly with a stepped deflector configured according to an embodiment of the present disclosure.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100*a*, 100*b* or by a prime for example, 100', 100" etc. It is to be understood that the use of letters or primes immediately after a reference number indicates that these features are similarly shaped and have similar function as is often the case when geometry is mirrored about a plane of symmetry. For ease of explanation in this specification, letters and primes will often not be included herein but may be shown in the drawings to indicate duplications of features, having similar or identical function or geometry, discussed within this written specification.

Various embodiments of a stepped deflector for use with a paving machine will be discussed herein that may increase the deflector stiffness resulting in less deflection and hence less frictional force between the tamper bar and wear bar. This may lead to less maintenance on these components, etc.

First, an exemplary paving machine that may have a screed assembly using various embodiments of the deflector will be discussed looking at FIG. 1. The paving machine 10 is used to level and compact a paving material 12, such as hot mix asphalt, on a ground surface 14 to provide a mat 16 of paved material. As used herein, a "forward" position refers to positions that are that are located toward the front of the paving machine 10 with respect to a direction of travel 18 of the paving machine, while an "aft" position refers to positions that are located toward the rear of the paving machine 10 with respect to the direction of travel 18. The paving machine 10 generally includes a chassis 20, which may have a track-style traveling mechanism (shown) or may be on wheels, as well as a passenger cab 22 mounted on the chassis 20. In addition, it further includes a hopper 24 mounted near the forward end of the paving machine 10 that stores the paving material 12, as well as a distributing device 26, such as an auger, that distributes the paving material 12 on the ground surface 14.

Furthermore, the paving machine 10 also includes a screed assembly 100 that is configured to level and compact the paving material 12 on the ground surface 14. The screed assembly 100 is mounted on the aft side of the paving machine 10 behind the distributing device 26 via one or more arms 30, as shown. As explained in further detail below, the screed assembly 100 may include a main screed 102 and one or more extension screeds 104 that extend laterally from the main screed 102 with respect to a central axis 105 of the screed assembly 100 (see FIG. 2). A stepped deflector plate 200 may also be provided 200 for the reasons set forth above and explained further later herein.

Figure 2:
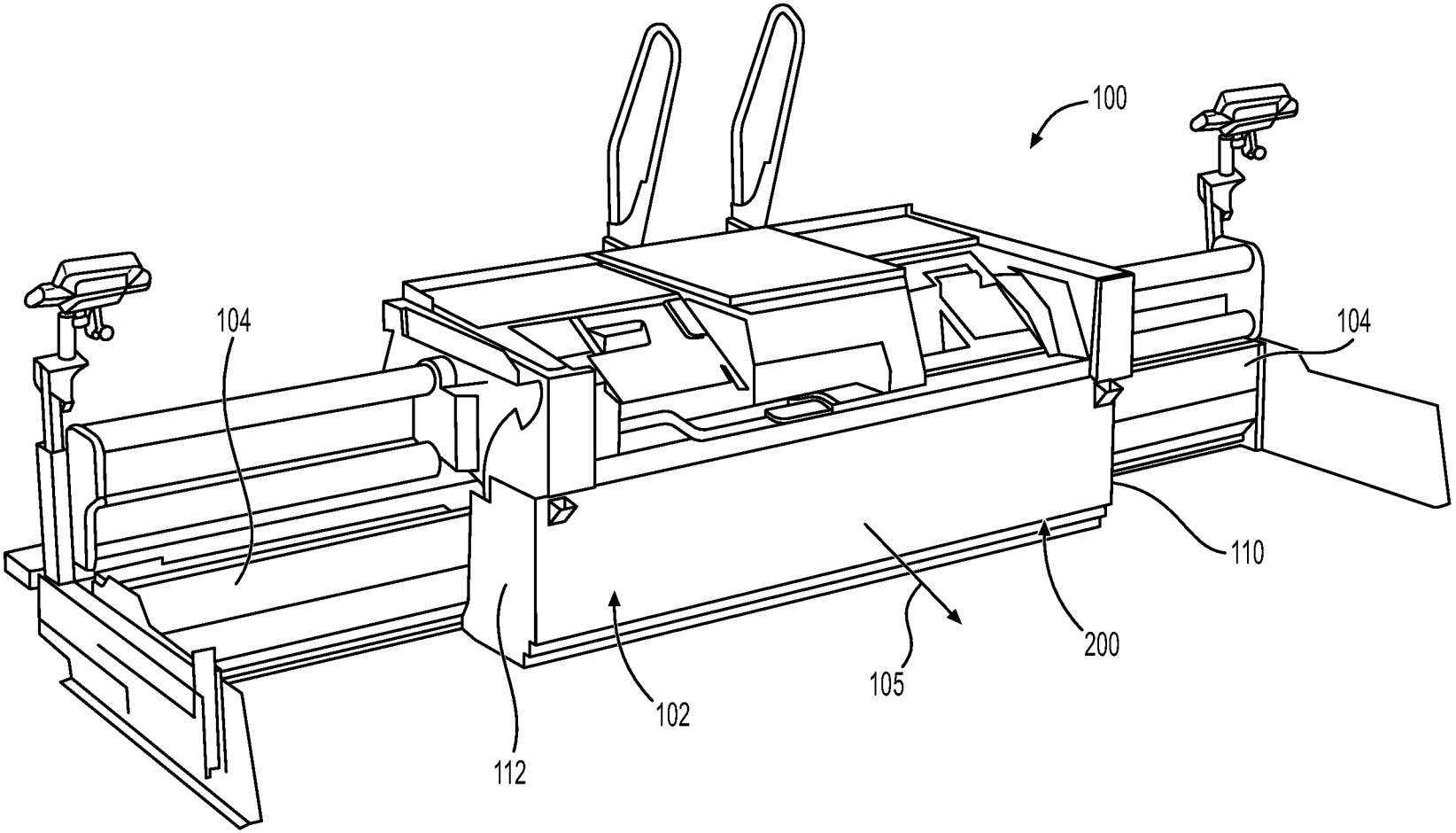
FIG. 2 is a front perspective view of the screed assembly employed in the paving machine of FIG. 1, shown in isolation.

Turning now to FIG. 2, the screed assembly 100 is shown in more detail. In the depicted arrangement, the main screed 102 is centrally located, and the extension screeds 104 are movably connected to the main screed 102 with one extension screed 104 on each lateral side of the main screed 102.

However, other possible arrangements may include a single extension screed, more than two extension screeds, or none at all. In the embodiment shown, the extension screeds 104 are laterally extendable with respect to the main screed 102/central axis 105 to adjust for variations in the width of the ground surface 14. Using an actuating mechanism (e.g., hydraulic cylinders, etc.), the extension screeds 104 are translated laterally inward toward the central axis 105 to a fully-retracted position (see FIG. 1), and laterally outward away from the central axis 105 to fully-extended position with a range of intermediate positions in between. In addition, the extension screeds 104 may be positioned axially aft of the main screed 102, as shown but not necessarily so.

Figure 3:
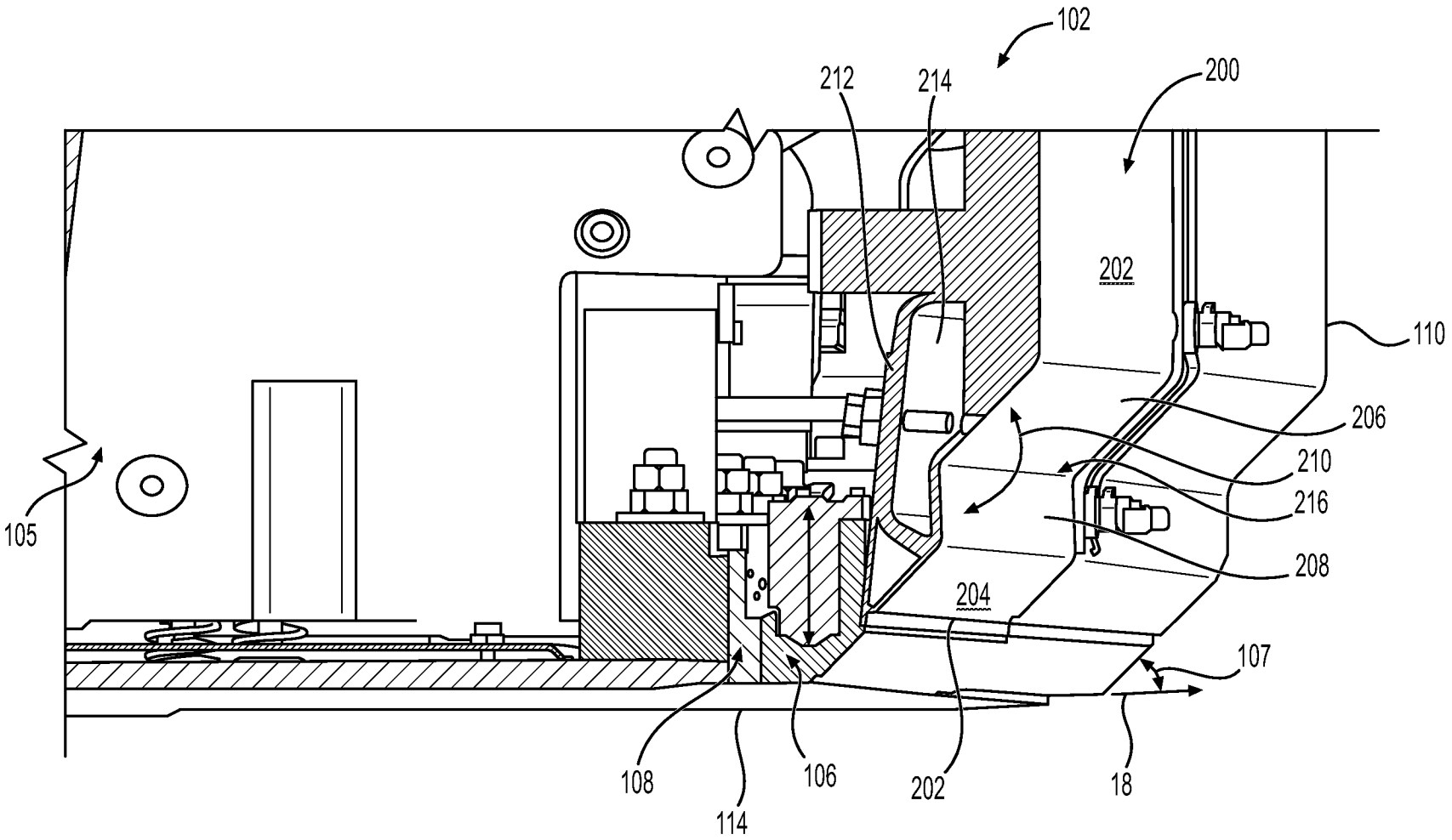
FIG. 3 is an enlarged partial sectional view of the screed assembly of FIG. 2, revealing the stepped geometry of the deflector plate, the tamper bar, and the wear bar more clearly.
Figure 4:
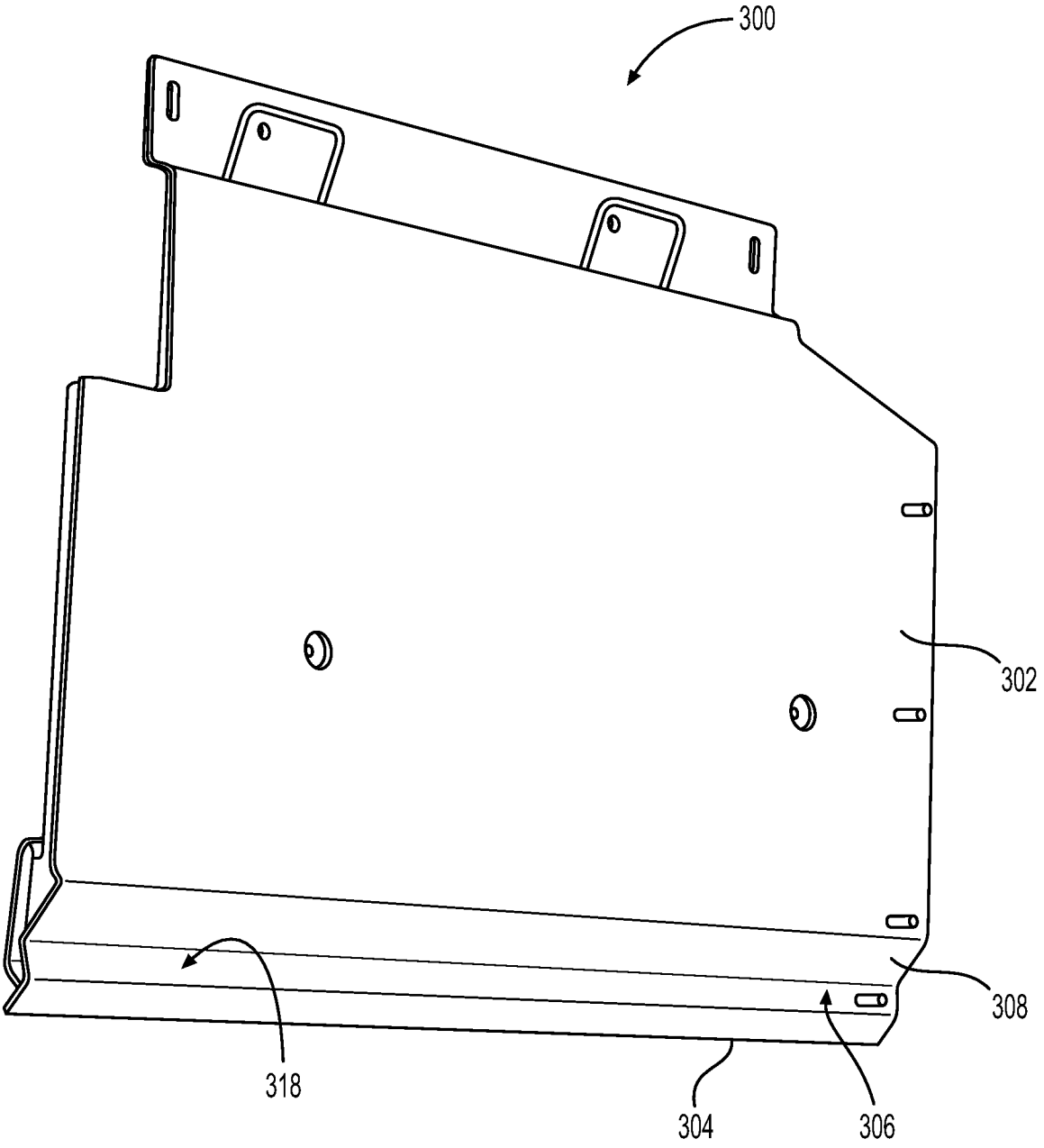
FIG. 4 is a front perspective view of a deflector plate similar to that of FIG. 3 shown in isolation.
Figure 5:
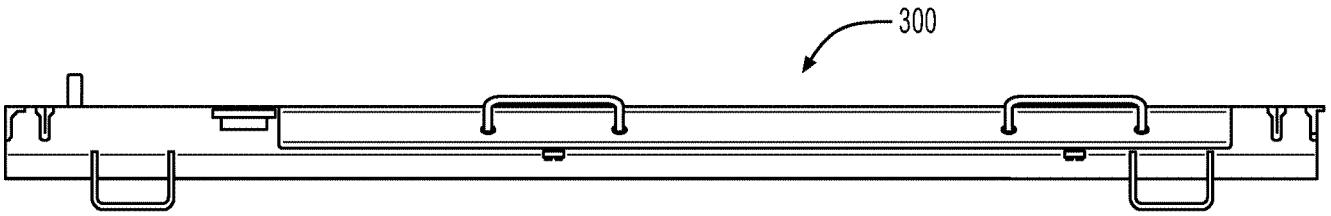
FIG. 5 is a top view of the deflector plate of FIG. 4.
Figure 6:
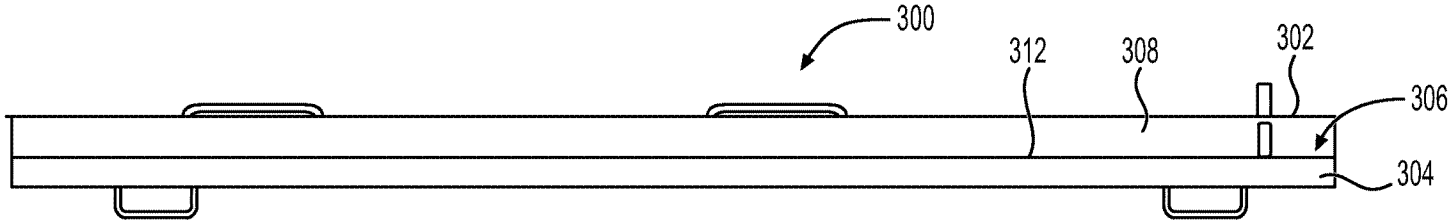
FIG. 6 a bottom view of the deflector plate of FIG. 4.

As best seen in FIG. 3, the screed assembly may comprise a stepped deflector plate 200 with a bottom edge 202, and a tamper bar 106 that is disposed near the bottom edge 202 (e.g. laterally toward the central axis 100 and aft of the bottom edge 202) of the stepped deflector plate 200 that is configured to move up and down vertically to pre-compact paving material. Also, a wear bar 108 may be disposed laterally adjacent to the tamper bar 106 toward the central axis 105.

The stepped deflector plate 200 may include a frontmost surface 202, a bottommost surface 204, and at least a pair of planar surfaces (e.g., a first planar surface 206, a second planar surface 208) connecting the frontmost surface 202 to the bottommost surface 204. The pair of planar surfaces 206, 208 may form an external angle 210 with each other that is 90.0 degrees or greater. For example, the external angle 210 may range from 90.0 degrees to 160.0 degrees in some embodiments of the present disclosure. Also, a pair of side plates (e.g., a first side plate 110, a second side plate 112, see also FIG. 2), and a bottom horizontally-extending main screed plate 114 may be provided.

Focusing on FIG. 3, it can be seen that the deflector may be arranged as a subassembly including a straight back plate 212 that is attached (e.g., via welding, fastening, etc.) to the stepped deflector plate 200, as well as a bent reinforcement plate 214 that is attached (e.g., via welding, fastening, etc.) to the stepped deflector plate 200. The straight back plate may be omitted in some embodiments, etc.

As shown in FIG. 3, the stepped deflector plate 200 may comprise a single step 216 that consists essentially of the pair of planar surfaces 206, 208. A plurality of similarly, dissimilarly, and identical steps may be employed in other embodiments of the present disclosure.

In the embodiment shown, one of the pair of planar surfaces 206 extends predominantly horizontally (e.g., forms an angle of 45.0 degrees or less with the direction of travel), while the other of the pair of planar surfaces 208 extends predominantly vertically (e.g., forms an angle that is greater than 45.0 degrees with the direction of travel). This may not be the case for other embodiments of the present disclosure.

Put another way, the tamper bar 106 may define a chamfer angle 107 relative to the direction of travel 18, and another pair of planar surfaces (e.g., see 204 and 206) that are offset from each other along a direction that is perpendicular to the direction of travel 18 (i.e., the vertical direction), and that are both parallel with the chamfer angle of the tamper bar. This may not the case in other embodiments of the present disclosure. These features have been described in reference to a main screed assembly, but it is to be understood that extension screed assemblies may also be similarly configured having similar stepped deflector plates, etc.

With continued reference to FIG. 3, the stepped deflector subassembly may include the stepped deflector plate 200 that is characterized as follows. A bottom compacting surface (e.g., may take the form of the bottommost surface 204) as well as a front surface (e.g., see frontmost surface 202) may be provided. An attack surface (e.g., may take the form of the first planar surface 206, other configurations are possible) may extend rearwardly from the front surface, while an accumulation surface (e.g., may take the form of the second planar surface 208, other configurations are possible) may extend downwardly from the attack surface toward the bottom compacting surface.

The attack surface is so called since it starts funneling the paving material and pressing down on it, while the accumulation surface is so called since some material will reach this surface and stop until enough pressure is created to force the material under the bottom compacting surface.

Figure 7:
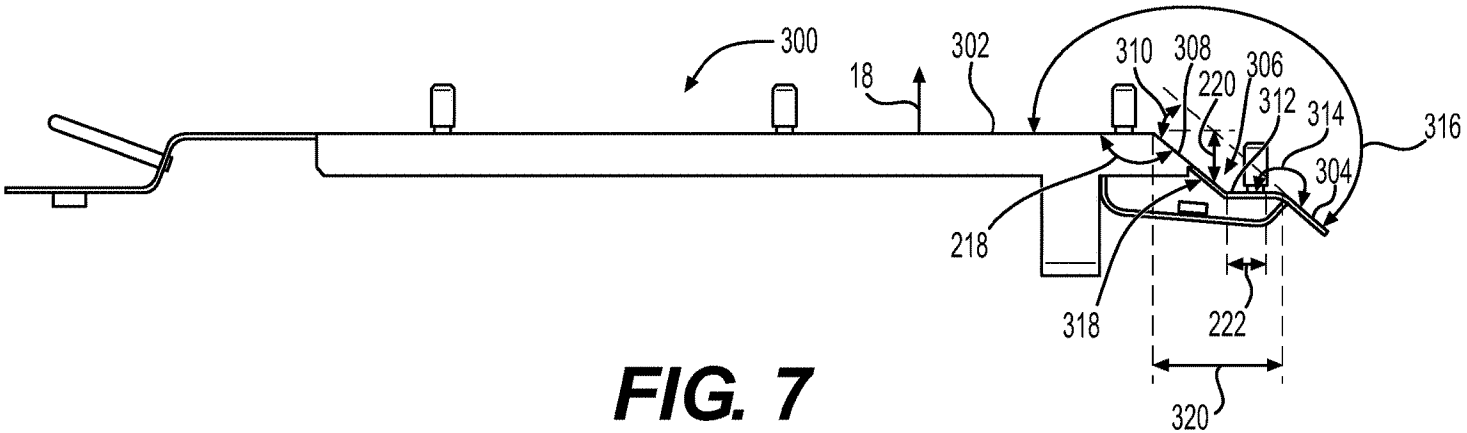
FIG. 7 is a side view of the deflector plate of FIG. 4.

The attack surface may form a first included angle 218 (see FIG. 7) with the front surface that ranges from 92.5 degrees to 120.0 degrees. Other ranges are possible. In addition, the attack surface defines an attack depth 220 along the direction of travel 18, while the accumulation surface defines a height 222 measured vertically (i.e. along a direction that is perpendicular to the direction of travel 18, and the lateral direction) from the bottom compacting surface to the attack surface that is less than attack depth 220.

Next, a deflector 300 that may be provided as a replacement part for a screed assembly similar or identical to that just described will now be discussed with reference to FIGS. 4 thru 8

The deflector 300 may have a front surface 302, a bottom surface 304, and a stepped transition 306 connecting the front surface 302 to the bottom surface 304. More specifically, the stepped transition 306 may include a ledge surface 308 that is interposed (e.g., along the direction of travel, laterally, and vertically) between the front surface 302, and the bottom surface 304. This ledge surface 308 may form an acute external angle 310 with a direction that is parallel to the bottom surface 304 that ranges from 0 to 30.0 degrees in some embodiments of the present disclosure. In some embodiments, this acute external angle 310 may range from 0 to 5.0 degrees.

Moreover, the stepped transition 306 may include a lower front facing surface 312 that connects the ledge surface 308 to the bottom surface 304. This lower front facing surface 312 may form an obtuse external angle 314 with the ledge surface 308 that ranges from 90.0 to 120.0 degrees. In some embodiments, this obtuse external angle may range from 95.0 degrees to 105.0 degrees.

Also, the front surface 302 may form another obtuse external angle 316 with the bottom surface 304 that ranges from 90.0 degrees to 120.0 degrees (e.g., may range from 95.0 degrees to 105.0 degrees). The ledge surface 308, and the bottom surface 304 may be parallel or substantially parallel (e.g., within 10.0 degrees) of each other in some embodiments of the present disclosure.

The ledge surface 308, and the lower front facing surface 312 may define at least a first step 318 of the stepped transition 306. While a single step is shown, a plurality of such steps may be provided. One or more of these steps may define a step height 320 (see FIG. 7, measured vertically when installed), and a step depth (may be the same as 220 measured along the direction of travel when installed) that is less than the step height 320. This may not be the case for other embodiments of the present disclosure.

Any of the plates described herein may be manufactured from any suitable material including, but not limited to, steel, aluminum, iron, cast-iron, grey cast-iron, and thermoplastics. Any of these components may be machined.

Any of the dimensions, angles, ration configurations, materials, etc. discussed herein may be varied as needed or desired to be different than any value or characteristic specifically mentioned herein or shown in the drawings for any of the embodiments. It is to be understood that the angles are measured in a plane containing the travel of direction, and the vertical direction.

INDUSTRIAL APPLICABILITY

In practice, a paving machine, a screen assembly, a deflector subassembly, and/or a deflector plate or replacement kit (that may include one or more of these items) constructed according any embodiment disclosed herein may be sold, bought, manufactured or otherwise obtained in an OEM (original equipment manufacturer) or after-market context. In some cases, various components, may be provided as a kit to repair or retrofit a machine in the field.

Any of the angled or bent plates, including the stepped deflector plate may be manufactured via a bending process such as using a brake press, progressive die operation, etc.

The stepped geometry of the stepped deflector plate may increase the deflector stiffness resulting in less deflection and hence less frictional force between the tamper bar and wear bar. This may reduce the wear of these components. Also, the stepped deflector plate may provide additional floatation of the screed as the asphalt pile flows under the screed, creating an extra vertical force into the screed through the stepped deflector geometry. Since the screed may float better with this increased vertical force, the tamper bar speed may possibly be reduced which also slows down the wear on the tamper bar and wear bar.

Again, other embodiments and configurations of the deflector or deflector plate are contemplated herein and are intended to be within the scope of the present application. For example, a plurality of smaller steps may be provided in the transitional region of the deflector, etc. Other features such as handles may be attached to the stepped deflector plate to aid in removal from the screed assembly, etc.

As used herein, the articles "a" and "an" are intended to include one or more items, and may be used interchangeably with "one or more." Where only one item is intended, the term "one" or similar language is used. Also, as used herein, the terms "has", "have", "having", "with" or the like are intended to be open-ended terms. Further, the phrase "based on" is intended to mean "based, at least in part, on" unless explicitly stated otherwise.

Recitation of ranges of values herein are merely intended to serve as a shorthand method of referring individually to each separate value falling within the range, unless otherwise indicated herein, and each separate value is incorporated into the specification as if it were individually recited herein.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, it is intended that the specification and examples be considered as exemplary only, with a true scope and spirit of the invention(s) being indicated by the following claims and their equivalents.

What is claimed is:

1. A deflector for use with a screed assembly, the deflector comprising:

a front surface;

a bottom surface; and a stepped transition connecting the front surface to the bottom surface, wherein the stepped transition includes a ledge surface that is interposed between the front surface and the bottom surface, wherein the ledge surface forms an acute angle with the bottom surface that ranges from 0 to 30.0 degrees, and wherein the stepped transition includes a lower front facing surface that connects the ledge surface to the bottom surface.

2. The deflector of claim 1, wherein the lower front facing surface forms an obtuse angle with the ledge surface that ranges from 90.0 to 120.0 degrees.

3. The deflector of claim 2, wherein the acute angle ranges from 0 to 5.0 degrees.

4. The deflector of claim 3, wherein the obtuse angle ranges from 95.0 degrees to 105.0 degrees.

5. The deflector of claim 4, wherein the front surface forms another obtuse angle with the bottom surface that ranges from 90.0 degrees to 120.0 degrees.

6. The deflector of claim 5, wherein the ledge surface and the lower front facing surface define at least a first step of the stepped transition.

7. The deflector of claim 2, wherein the at least first step of the stepped transition defines a step height, and a step depth that is less than the step height.

8. A stepped deflector for use with a screed assembly, the stepped deflector comprising:

a stepped plate including a bottom compacting surface;

a front surface;

an attack surface extending rearwardly from the front surface wherein the attack surface is a first planar surface; and an accumulation surface extending downwardly from the attack surface toward the bottom compacting surface, wherein the accumulation surface is a second planar surface, and wherein together the attack surface and the accumulation surface form a stepped transition connecting the front surface to the bottom compacting surface, wherein the attack surface defines an attack depth and the accumulation surface defines a height measured from the bottom compacting surface to the attack surface that is less than attack depth.

9. The stepped deflector of claim 8, wherein the attack surface forms a first included angle with the front surface that ranges from 92.5 degrees to 120.0 degrees.

10. A screed assembly for use with a paving machine with a direction of travel, the screed assembly comprising:

a stepped deflector plate with a bottom edge; and a tamper bar disposed near the bottom edge of the stepped deflector plate that is configured to move up and down vertically to pre-compact paving material, the tamper bar defining a chamfer angle relative to the direction of travel;

wherein the stepped deflector plate includes a frontmost surface, a bottommost surface, and at least a pair of planar surfaces that are offset from each other along a direction that is perpendicular to the direction of travel, and that are both parallel with the chamfer angle of the tamper bar.

11. The screed assembly of claim 10, further comprising a pair of side plates, and a bottom horizontally extending main screed plate.

12. The screed assembly of claim 10, further comprising a straight back plate that is attached to the stepped deflector plate, or a bent reinforcement plate that is attached to the stepped deflector plate.

13. The screed assembly of claim 10, wherein the stepped deflector plate comprises a single step that consists essentially of the pair of planar surfaces.

14. The screed assembly of claim 10, further comprising a wear bar that is disposed laterally adjacent to the tamper bar.

15. The screed assembly of claim 10, further comprising a frontmost surface extending along a direction that is perpendicular to the direction of travel, and an intermediate surface that is interposed between the pair of planar surfaces, the intermediate surface being parallel with the frontmost surface.

16. The screed assembly of claim 10, wherein the screed assembly is a main screed assembly.

17. The screed assembly of claim 10, wherein the stepped deflector plate is manufactured via a bending process.

* * * * *